US006752476B2

(12) United States Patent
Lin

(10) Patent No.: US 6,752,476 B2
(45) Date of Patent: Jun. 22, 2004

(54) STRUCTURE OF A GARBAGE-BOX

(76) Inventor: Chung Jen Lin, P.O. Box 82-144, Taipei (TW)

( * ) Notice: Subject to any disclaimer, the term of this patent is extended or adjusted under 35 U.S.C. 154(b) by 303 days.

(21) Appl. No.: 09/880,808

(22) Filed: Jun. 15, 2001

(65) Prior Publication Data

US 2002/0190615 A1 Dec. 19, 2002

(51) Int. Cl.[7] ..... A47B 81/00

(52) U.S. Cl. ..... 312/290; 312/297; 312/319.7; 160/37; 160/188; 318/480

(58) Field of Search ..... 312/292, 319.7, 312/290, 307, 319.5; 160/235, 37, 36, 214, 188; 248/142; 318/3, 9, 10, 16, 480; 220/211, 908, 345.1, 262

(56) References Cited

U.S. PATENT DOCUMENTS

| | | | | | |
|---|---|---|---|---|---|
| 623,642 | A | * | 4/1899 | Wallen, Sr. | 312/290 |
| 2,531,444 | A | * | 11/1950 | Lane | 312/290 |
| 2,739,730 | A | * | 3/1956 | Jonas | 312/297 |
| 3,129,040 | A | * | 4/1964 | De Rose | 312/297 |
| 3,204,866 | A | * | 9/1965 | Brighton et al. | 312/290 |
| 3,666,169 | A | * | 5/1972 | Eaton | 312/297 |
| 4,966,219 | A | * | 10/1990 | Sonolet | 160/37 |
| 4,981,275 | A | * | 1/1991 | Sheu | 312/319.5 |
| 5,329,212 | A | * | 7/1994 | Feigleson | 318/480 |
| 5,932,982 | A | * | 8/1999 | Pezzelli, Jr. | 318/480 |
| 6,085,825 | A | * | 7/2000 | Swink et al. | 160/188 |
| 6,334,542 | B1 | * | 1/2002 | Hsu | 220/908 |
| 6,422,672 | B1 | * | 7/2002 | Searer | 312/297 |

FOREIGN PATENT DOCUMENTS

| | | | | |
|---|---|---|---|---|
| EP | 0310548 | * | 4/1989 | 312/297 |
| JP | 910748 | * | 9/1997 | |

* cited by examiner

*Primary Examiner*—Lanna Mai
*Assistant Examiner*—Hanh V. Tran
(74) *Attorney, Agent, or Firm*—Leong C. Lei

(57) ABSTRACT

A structure of a garbage-box having a container body and a collection container, a moving door module being provided to the garbage inlet of the container body, characterized in that a sensor is provided to a top plate of the container body to sense the approaching of a person to open the moving door on the container body, another sensor is located within the container body, a pair of corresponding inverted L-shaped guiding rail seat are provided at the inner wall of the container body, the transmission shaft is pivotally mounted to the two guiding rail seats, the two ends of the transmission shaft are respectively mounted with a zigzag gear to drive flexible moving door, the bottom end of the flexible moving door, corresponding to the micro-touch switch, is provided with a pushing block so as to sense the opening of the flexible moving door.

3 Claims, 4 Drawing Sheets

STRUCTURE OF A GARBAGE-BOX

BACKGROUND OF THE INVENTION (a) Field of the Invention

The present invention relates to a garbage-box, and in particular, to a garbage-box having a garbage inlet in combination with a flexible moving door, such that the door can automatically close the garbage inlet or automatically open the garbage inlet.

(b) Description of the Prior Art

FIG. 1 shows a conventional large size garbage-box having a hollow container body 10. FIG. 1A illustrates the operation of the door of the conventional garbage-box. The top face of the container body 10 is provided with a garbage inlet 11, and a door 12 is pivotally mounted to the garbage inlet 11. The lower section of the container body 10 is provided with a collection container 15 which can be withdrawn from the front lateral side of the container body 10. In operation, the moving door 12 is pushed away and garbage is thrown into the collection container 15 of the container body 10 via the garbage inlet 11. This conventional garbage-box has the following drawbacks.

(1) The collection of garbage is not convenient. The operator has to first open the moving door 12 and the hands of the operator will come into contact with the garbage-box 10. This is inconvenient and not hygienic.

(2) The moving door cannot be closed under normal operating condition. As the moving door 12 needs a space in order to rotate, if the garbage has been stacked up to the garbage inlet 11, the moving door 12 cannot be opened, or after the moving door is opened, it cannot be closed. Therefore, this conventional garbage structure is inconvenient in operation. In a more serious situation, the bad smell of the garbage will pollute the environment.

(3) The height of the garbage pile cannot be determined. There is not detection device to measure or to detect the height of stacked garbage. Thus, the piled garbage may cause the moving door 12 from closing and opening, and the overflow of garage will affect the environment. Therefore, the clearing of the garbage is different.

SUMMARY OF THE INVENTION

Accordingly, it is an object of the present invention to provide a structure of a garbage-box, having a container body and a collection container, a moving door module being provided to the garbage inlet of the container body, characterized in that, a sensor is provided to the top plate of the container body to sense the approaching of a person to open the moving door on the container body, a further sensor is located within the container body higher than the height of the collection container so as to detect the height of the stacked garbage, on the moving door module, a pair of corresponding inverted L-shaped guiding rail seats are provided at the inner wall of the container body, the guiding rail seat is provided with a corresponding guiding slot, and the top and bottom section of the vertical section of the corresponding guiding slot are provided with a micro-touch switch, and one lateral side of the guiding rail is provided with a servo motor which can drive a transmission shaft, and the transmission shaft is pivotally mounted to the two guiding rail seats, and the two ends of the transmission shaft are respectively mounted with a zigzag gear to drive a flexible moving door, the bottom end of the flexible moving door, corresponding to the micro-touch switch, is provided with a pushing block so as to sense the opening of the flexible moving door, thereby an improved structure of a garbage-box with a large garbage inlet is formed.

Other object and advantages of the present invention will become more apparent from the following description taken in conjunction with the accompanying drawings.

DETAILED DESCRIPTION OF THE PRESENT INVENTION

Figure 1:
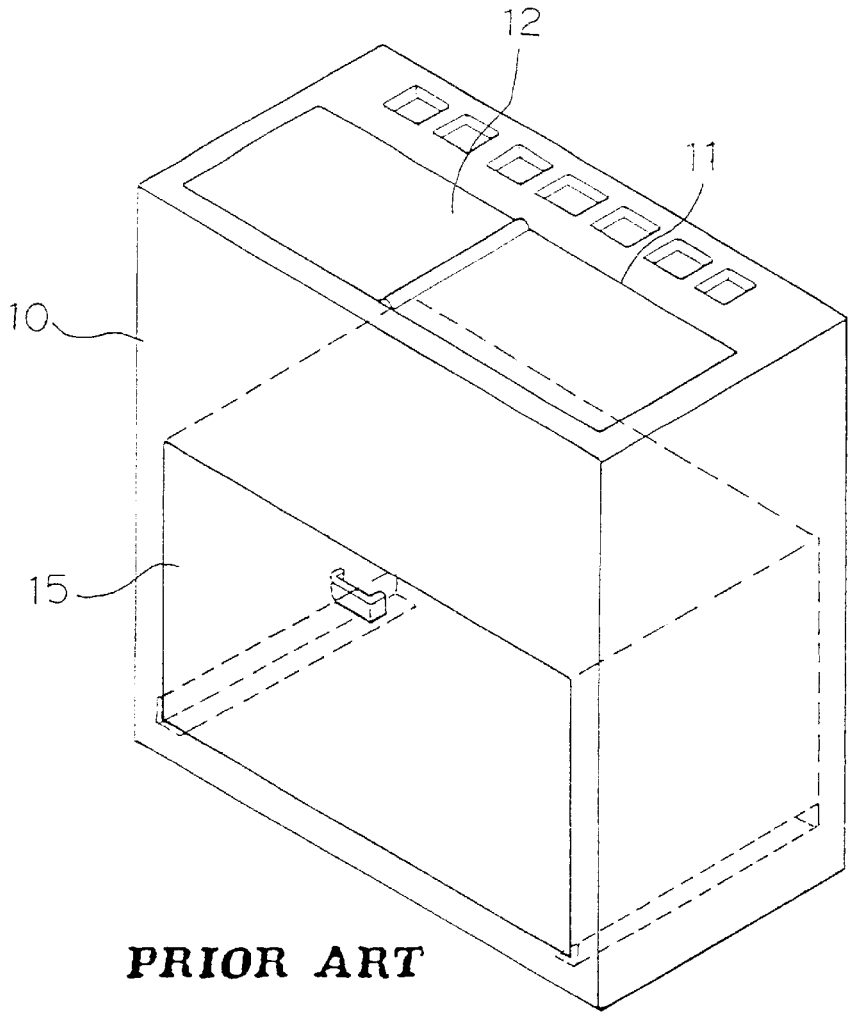
PRIOR ART FIG. 1
FIG. 1 is a schematic view of a conventional garbage-box and the application thereof.
Figure 1A:
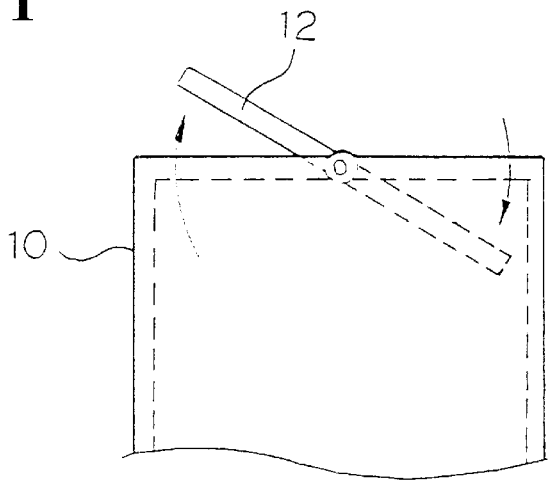
PRIOR ART FIG. 1A
FIG. 1A illustrates the operation of the door of the conventional garbage-box.
Figure 2:
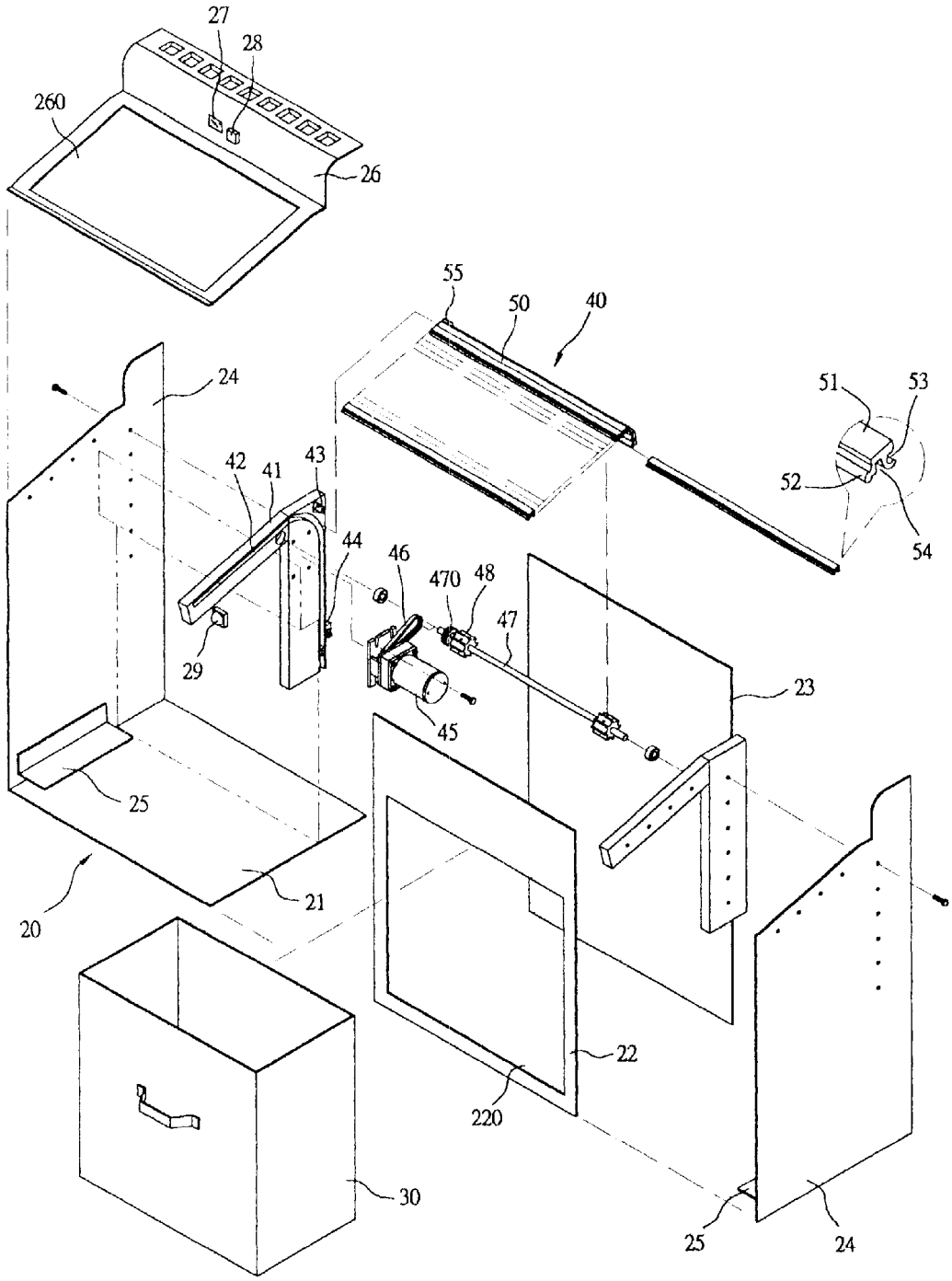
FIG. 2 is an exploded perspective view of the structure of the garbage-box of the present invention.
Figure 3:
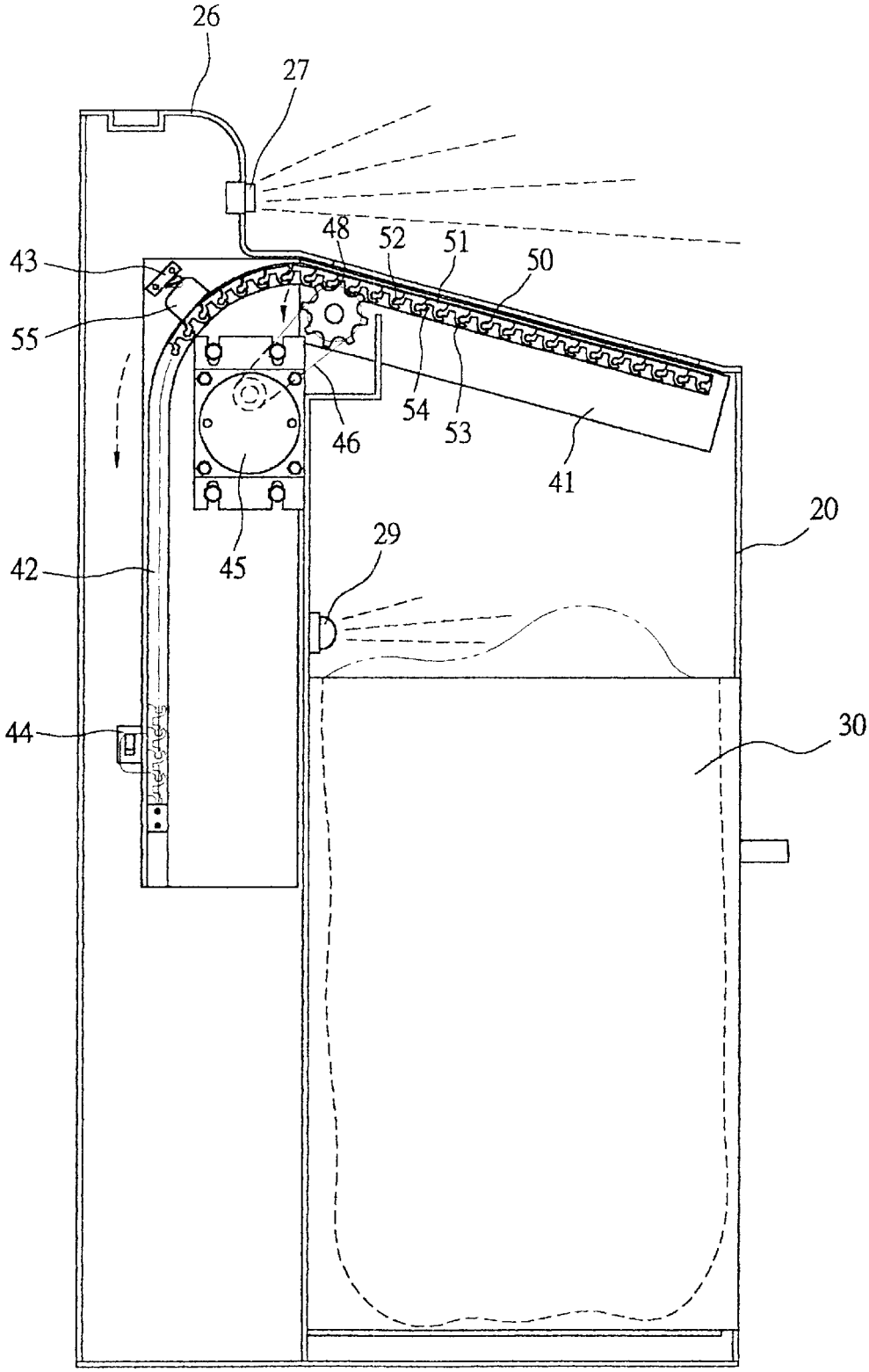
FIG. 3 is a sectional view of the present invention, illustrating the relationship of the elements of the garbage-box of the present invention.

Referring to FIGS. 2 and 3, there is shown an improved structure of a garbage-box having a garbage inlet 260 on the container body 20, and a collection container 30. On the top of the garbage inlet 260, a moving door module 40 having a flexible moving door 50. The garbage inlet 260 can be automatically closed or opened.

Again, referring to FIGS. 2 and 3, the container body 20 is provided with a bottom plate 21, and the front and rear edge are respectively provided with a front and rear lateral plates 22, 23. The front lateral plate 22 is provided with a through hole 220 allowing the collection container 30 to pass through. The bottom plate 21 is further provided with two lateral plates 24, and the bottom edge of the lateral plate 24 is provided with sliding rail 25 for the sliding of the collection container 30. The top edges of the lateral plates 22, 23, 24 are joined by a top plate 26 having a garbage inlet 260 to form the container body 20 of the garbage-box. An ashtray is provided at the top plate 26, and a sensor 27 also provided thereto so as to detect the approaching of a person or a button 28 for direct control of the garbage inlet 260 is provided to the top plate 26. Another sensor 29 is mounted on an inner surface of the rear lateral plate 23 at a height higher than the position of the collection container 30 to detect the height of the stacked garbage.

A pair of corresponding inverted L-shaped guiding rail seats 41 are respectively mounted onto the two lateral plats 24, and the guiding rail seat 41 is provided with a corresponding guiding slot 42, and the guiding rail seat 41 corresponding to the top and bottom end of the vertical section of the corresponding guiding slot 42 is provided with the micro-touch switches 43, 44. A servomotor 45 is provided to one lateral side of the guiding rail seat 41, and the transmission shaft 47 of a belted wheel 470 drives the servomotor 45 via a belt 47. The transmission shaft 47 is pivotally mounted to the two guiding rail seats 41. The two ends of the transmission shaft 47 are provided with the zigzag gear 48 to drive the flexible moving door 50.

The flexible moving door 50 is formed from a plurality of combination rods 51. The lateral side of the combination rod 51 is provided with a protruded round stripe 52 and an engaging slot 53 so that the adjacent rods 51 can be mounted together and rotatable. The bottom edge of the combination rod 51 has a recessed slot 54 to accommodate the zigzag gear of the transmission shaft 47.

A pushing block 55 is provided to the combination rod 51 at the bottom end of the flexible moving door 50. This pushing block 55 corresponds to the micro-touch switches 43, 44 so as to detect the opening or closing of the flexible moving door 50. Therefore, an improved garbage-box having a large garbage inlet 260 is obtained.

Figure 4:
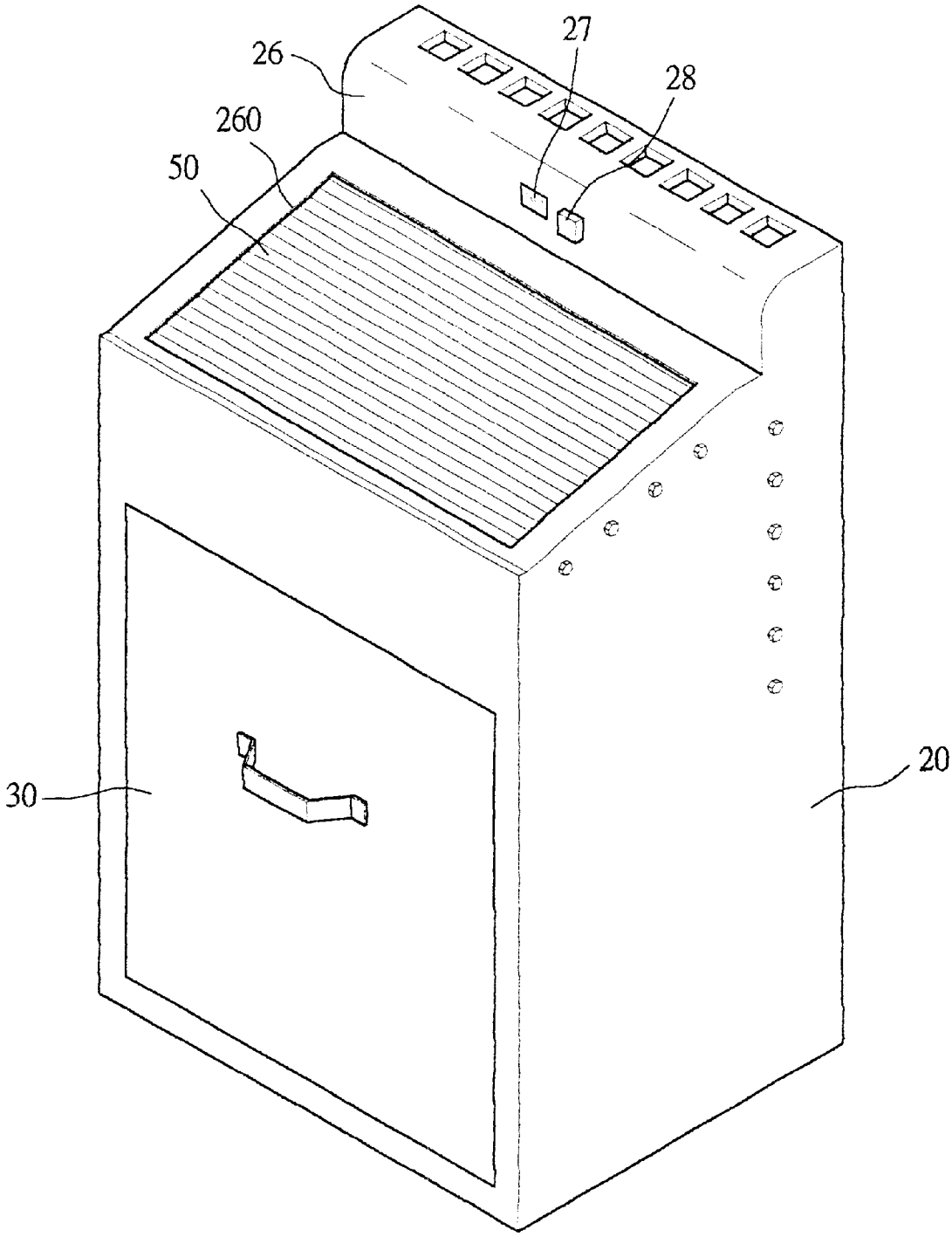
FIG. 4 is a perspective view of the garbage-box of the present invention.

As shown in FIGS. 3 and 4, in operation, if a user approaches the garbage-box the sensor 27 detects the user and the servomotor 45 is initiated to move the transmission shaft 47. The zigzag gear 48 of the transmission shaft 47 drives the flexible moving door 50. The door 50 slides downward along the guiding slot 42 of the guiding rail seat 41 and stops when the push block 55 touches the micro-touch switch 44 for the user to discard garbage.

When the user leaves the garbage-box, the servomotor 45 moves in a reverse direction and the flexible moving door 50 moves upward to close until the push block 55 touches the other micro-touch switch 43. The user can control the door 50 by using the control button 28 on the garbage-box. The sensor 29 within the container body 20 detects the height of the stacked garbage.

The advantages of the present invention are as follows:

(1) The garbage inlet of the garbage-box is extended. As the door 50 can be closed or opened along the inner wall of the container body, the space required for the top plate 26 is greatly reduced. Thus, the garbage inlet 260 on the top plate 26 can be enlarged, allowing the user to conveniently discard garbage.

(2) Longevity of Motor. As a zigzag gear 48 is utilized in the transmission shaft 47 to direct control the door 50. The transmitted force is great and the speed is fast. Thus, the power needed is lesser and the cost of operation is reduced. Further, the longevity of the motor is extended.

While the invention has been described with respect to preferred embodiment, it will be clear to those skilled in the art that modifications and improvements may be made to the invention without departing from the spirit and scope of the invention. Therefore, the invention is not to be limited by the specific illustrative embodiment, but only by the scope of the appended claims.

I claim:

1. A structure of a garbage-box having a container body and a collection container, a flexible moving door module being provided to the garbage inlet of the container body, wherein a sensor is provided to a top plate of the container body to sense the approaching of a person to open the moving door module on the container body, a further sensor is located within the container body at a position higher than the height of the collection container so as to detect the height of the stacked rubbish, on the moving door module, a pair of corresponding inverted L-shaped guiding rail seats are provided at the inner wall of the container body, each guiding rail seat is provided with a corresponding guiding slot, and the top and bottom section of the vertical section of the corresponding guiding slot are provided with a micro-touch switch, and one lateral side of the guiding rail is provided with a servo motor which can drive a transmission shaft, and the transmission shaft is pivotally mounted to the two guiding rail seats, and the two ends of the transmission shaft are respectively mounted with a zigzag gear to drive flexible moving door module, the bottom end of the flexible moving door, corresponding to the micro-touch switch, is provided with a pushing block so as to sense the opening of the flexible moving door, thereby an improved structure of a garbage-box with a large garbage inlet is formed.

2. The structure of a garbage-box of claim 1, wherein the top face of the container body is provided with controlling buttons for direct controlling.

3. The structure of a garbage-box of claim 1, wherein the flexible moving door module is formed from a plurality of combination rods, the two lateral sides of each rod are formed into corresponding protruded rounded engaging stripe and engaging slot such that the adjacent combination rod is pivotally combined and is rotatable, and the bottom edge of the combination rod is formed into a recess to accommodate the zigzag gear of the transmission shaft.

* * * * *